US009057350B2

(12) United States Patent
Koudu et al.

(10) Patent No.: US 9,057,350 B2
(45) Date of Patent: Jun. 16, 2015

(54) STARTER

(71) Applicant: DENSO CORPORATION, Kariya, Aichi-pref. (JP)

(72) Inventors: Takuma Koudu, Kariya (JP); Akina Kuwada, Kariya (JP)

(73) Assignee: DENSO CORPORATION, Kariya (JP)

( * ) Notice: Subject to any disclaimer, the term of this patent is extended or adjusted under 35 U.S.C. 154(b) by 152 days.

(21) Appl. No.: 13/644,406

(22) Filed: Oct. 4, 2012

(65) Prior Publication Data

US 2013/0087015 A1 Apr. 11, 2013

(30) Foreign Application Priority Data

Oct. 7, 2011 (JP) ..... 2011-222407

(51) Int. Cl.

| | |
|---|---|
| ***F02N 15/02*** | (2006.01) |
| ***F02N 15/06*** | (2006.01) |
| *F02N 11/00* | (2006.01) |
| *F02N 15/04* | (2006.01) |
| *F02N 11/08* | (2006.01) |

(52) U.S. Cl.

CPC ..... *F02N 15/062* (2013.01); *Y10T 74/132* (2015.01); *F02N 11/00* (2013.01); *F02N 15/022* (2013.01); *F02N 15/046* (2013.01); *F02N 15/067* (2013.01); *F02N 11/0814* (2013.01); *F02N 15/023* (2013.01); *F02N 15/065* (2013.01); *F02N 2250/08* (2013.01)

(58) Field of Classification Search

CPC ... F02N 15/023; F02N 15/067; F02N 15/022; F02N 15/06; F02N 15/043

USPC ..... 74/6, 7 A, 7 R, 7 C

See application file for complete search history.

(56) References Cited

U.S. PATENT DOCUMENTS

| | | | | |
|---|---|---|---|---|
| 4,573,364 | A * | 3/1986 | Givan | 74/7 E |
| 4,818,889 | A | 4/1989 | Kinoshita | |
| 4,862,027 | A * | 8/1989 | Isozumi et al. | 310/99 |

(Continued)

FOREIGN PATENT DOCUMENTS

| | | | |
|---|---|---|---|
| EP | 0 562 475 | A1 | 9/1993 |
| EP | 1 306 549 | A2 | 5/2003 |
| JP | A-2006-177168 | | 7/2006 |

OTHER PUBLICATIONS

Extended Search Report issued in European Patent Application No. 12186159.5 dated Oct. 29, 2013.

(Continued)

*Primary Examiner* — Justin Krause
(74) *Attorney, Agent, or Firm* — Oliff PLC

(57) ABSTRACT

In a starter, an output shaft is coaxially disposed with a rotating shaft of a motor and has male helical splines formed on its outer surface. A pinion tube has female helical splines formed on its inner surface and is fitted on the output shaft with the female helical splines in mesh with the male helical splines. A pinion is provided on a non-motor-side end portion of the pinion tube so as to rotate with the pinion tube. A shift lever is configured to shift both the pinion tube and the pinion relative to the output shaft and thereby bring the pinion into mesh with a ring gear of an engine. Further, there is provided means for restricting relative rotation between the pinion tube and the output shaft when a one-way clutch is in an overrun state where the clutch inhibits torque transmission from the output shaft to the motor.

7 Claims, 3 Drawing Sheets

(56) References Cited

U.S. PATENT DOCUMENTS

| | | | | |
|---|---|---|---|---|
| 5,014,563 | A * | 5/1991 | Isozumi | 74/7 R |
| 5,052,235 | A * | 10/1991 | Isozumi | 74/7 E |
| 5,432,384 | A | 7/1995 | Isozumi et al. | |
| 5,819,583 | A | 10/1998 | Matsushima et al. | |
| 7,018,314 | B2 | 3/2006 | Hasegawa et al. | |
| 7,305,899 | B2 | 12/2007 | Kajino et al. | |
| 2006/0144177 | A1 | 7/2006 | Andoh | |
| 2008/0314195 | A1 | 12/2008 | Andoh et al. | |
| 2009/0205464 | A1 | 8/2009 | Takeuchi et al. | |
| 2013/0087016 | A1 * | 4/2013 | Koudu et al. | 74/7 A |
| 2013/0087017 | A1 | 4/2013 | Kuwada et al. | |

OTHER PUBLICATIONS

U.S. Appl. No. 13/644,435, filed Oct. 4, 2012.
Feb. 9, 2015 Office Action issued in U.S. Appl. No. 13/644,435.

* cited by examiner (STOPPED STATE)

(DRIVING STATE)

STARTER

CROSS-REFERENCE TO RELATED APPLICATION

This application is based on and claims priority from Japanese Patent Application No. 2011-222407, filed on Oct. 7, 2011, the content of which is hereby incorporated by reference in its entirety into this application.

BACKGROUND

1. Technical Field

The present invention relates to starters which have a pinion tube spline-fitted on an output shaft and are configured to shift the pinion tube relative to the output shaft in a direction away from a motor and thereby bring a pinion supported on a non-motor-side end portion of the pinion tube into mesh with a ring gear of an engine.

2. Description of Related Art

There is disclosed, for example in Japanese Patent Application Publication No. 2006-177168, a starter that has a cantilever structure.

Specifically, as shown in FIG. 3, the starter includes: an output shaft 100 configured to be driven by a motor (not shown); a pinion tube 120 fitted on the output shaft 100 via a pair of sliding bearings 110; a one-way roller clutch 130 configured to transmit rotation of the output shaft 100 to the pinion tube 120; a pinion 140 that is straight-spline-fitted on a non-motor-side end portion (i.e., a left end portion in FIG. 3) of the pinion tube 120; and a housing 160 that supports the pinion tube 120 via a ball bearing 150 axially positioned between the clutch 130 and the pinion 140. Further, the starter is configured so that with operation of an electromagnetic switch (not shown), the pinion tube 120 and the clutch 130 are together shifted relative to the output shaft 100 in the axial direction away from the motor (i.e., in the leftward direction in FIG. 3), thereby bringing the pinion 140 fitted on the pinion tube 120 into mesh with a ring gear (not shown) of an engine.

With the above starter, however, when the engine has been completely started and thus the pinion 140 comes to be rotated by the engine, the clutch 130 will enter an overrun state where the clutch 130 inhibits torque transmission from the pinion tube 120 (or from the engine side) to the output shaft 100 (or to the motor side). Consequently, the rotational speed of the pinion 140 and the pinion tube 120, which are together rotated by the engine, will become remarkably higher than the rotational speed of the output shaft 100 that is driven by the motor. Therefore, it is necessary to interpose the bearings 110 between the pinion tube 120 and the output shaft 100. In addition, the bearings 110 are press-fitted to the inner periphery of the pinion tube 120, and the output shaft 100 is inserted inside the bearings 110 so as to be rotatable relative to the bearings 110.

Moreover, in recent years, the number of motor vehicles, which are equipped with an Idling Stop System (ISS), has increased to meet the demands of improving fuel economy and reducing exhaust gases. An ISS is generally designed to stop injection of fuel into the engine and thereby automatically stop the engine when the vehicle makes a brief stop for, by way of example, waiting for a traffic light to change or traffic congestion. Therefore, for a starter used in a motor vehicle that is equipped with an ISS, the number of times the starter starts the engine of the vehicle is dramatically increased in comparison with a starter used in a motor vehicle without an ISS. Accordingly, it is required to secure high durability (or long service lives) of starters used in those motor vehicles which are equipped with an ISS.

However, when the starter disclosed in Japanese Patent Application Publication No. 2006-177168 is used in a motor vehicle equipped with an ISS, wear of the bearings 110, which are interposed between the output shaft 100 and the pinion tube 120, will be accelerated by the dramatic increase in the number of times the starter starts the engine of the vehicle. Consequently, relative inclination between the output shaft 100 and the pinion tube 120 will become large. In addition, wear of the bearings 110 occurs when the pinion 140 is rotated by the engine with the clutch 130 in its overrun state so that the bearings 110 are subjected to high-speed relative rotation between the output shaft 100 and the pinion tube 120 and also subjected to high load.

Moreover, with increase in the relative inclination between the output shaft 100 and the pinion tube 120, contact pressure at a spline engagement portion will be increased; at the spline engagement portion, male splines formed on an outer surface of the output shaft 100 engage with female splines formed on an inner surface of an outer of the clutch 130. Consequently, adhesion between the tooth surfaces of the male and female splines may occur, thereby making it difficult to secure high durability of the starter.

In addition, the female splines may be inclined relative to the male splines due to radial and circumferential clearances provided therebetween. In particular, when an ignition switch (or a starter switch) of the vehicle is again turned on after being turned on once and then turned off without completely starting the engine, the pinion 140, which is kept rotating by the inertial rotation of the starter motor, will be again brought into mesh with the ring gear of the engine. Consequently, the rotation of the pinion 140 will be suddenly stopped, inducing an excessive mechanical shock at the spline engagement portion and thereby causing relative inclination between the male and female splines. As a result, with the relative inclination between the male and female splines, an excessive contact pressure will be generated between the male and female splines due to local contact therebetween, thereby causing adhesion between the tooth surfaces of the male and female splines.

SUMMARY

According to an exemplary embodiment, there is provided a starter for starting an engine of a motor vehicle. The starter includes a motor, an output shaft, a one-way clutch, a pinion tube, a pinion, a shift lever and a relative rotation restricting means. The motor has a rotating shaft. The output shaft is coaxially disposed with the rotating shaft of the motor and has male helical splines formed on an outer surface thereof. The one-way clutch is configured to allow torque transmission from the motor to the output shaft and inhibit torque transmission from the output shaft to the motor. The pinion tube has female helical splines formed on an inner surface thereof and is fitted on the output shaft with the female helical splines in mesh with the male helical splines of the output shaft. The pinion is provided on a non-motor-side end portion of the pinion tube so as to rotate with the pinion tube. The shift lever is configured to shift both the pinion tube and the pinion relative to the output shaft in a direction away from the motor and thereby bring the pinion into mesh with a ring gear of the engine. The relative rotation restricting means restricts relative rotation between the pinion tube and the output shaft when the one-way clutch is in an overrun state where the clutch inhibits torque transmission from the output shaft to the motor.

With the above configuration, when the engine has been completely started and thus the pinion comes to be rotated by the engine, the clutch enters the overrun state where it inhibits torque transmission from the output shaft (i.e., from the engine side) to the motor. At this time, however, relative rotation between the output shaft and the pinion tube is restricted by the relative rotation restricting means, unlike in the conventional starter as disclosed in Japanese Patent Application Publication No. 2006-177168.

Consequently, without relative rotation between the output shaft and the pinion tube, it is possible to reliably suppress wear of the outer surface of the output shaft and the inner surface of the pinion tube even when the vehicle is equipped with an ISS and thus the number of times the starter starts the engine of the vehicle is dramatically increased. Therefore, it is unnecessary to provide a large radial clearance between the outer surface of the output shaft and the inner surface of the pinion tube for the purpose of suppressing wear of the two surfaces. In other words, it is possible to minimize the radial clearance between the outer surface of the output shaft and the inner surface of the pinion tube. As a result, with the minimized radial clearance, it is also possible to minimize relative inclination between the output shaft and the pinion tube.

Further, with the minimized relative inclination between the output shaft and the pinion tube, it is possible to reliably prevent local increase in contact pressure between the male helical splines of the output shaft and the female helical splines of the pinion tube, thereby reliably preventing adhesion between the tooth surfaces of the male and female helical splines. As a result, it is possible to secure high durability (or a long service life) of the starter.

Furthermore, without relative rotation between the output shaft and the pinion tube, it is unnecessary to provide a bearing between the outer surface of the output shaft and the inner surface of the pinion tube. Consequently, without having to provide a bearing between the outer surface of the output shaft and the inner surface of the pinion tube, it is possible to minimize the parts count and thus the manufacturing cost of the starter. Moreover, without a bearing provided between the outer surface of the output shaft and the inner surface of the pinion tube, it is possible to more effectively minimize the radial clearance therebetween.

In addition, even if a bearing was provided between the outer surface of the output shaft and the inner surface of the pinion tube, it would be possible to reliably prevent seizure of the bearing because relative rotation between the output shaft and the pinion tube would be restricted by the relative rotation restricting means when the clutch is in the overrun state.

In further implementations, the starter may further include an electromagnetic solenoid which includes an excitation coil that forms an electromagnet upon being supplied with electric power; the electromagnetic solenoid drives the shift lever to shift both the pinion tube and the pinion in the direction away from the motor by means of attraction of the electromagnet.

The relative rotation restricting means may be made up of the male helical splines of the output shaft, the female helical splines of the pinion tube and the shift lever. In this case, when the one-way clutch is in the overrun state, the tooth surfaces of the male helical splines will abut against those of the female helical splines in the rotating direction of the pinion tube and the shift lever will bear an axial thrust, which is created by the meshing engagement between the male and female helical splines to act on the pinion tube in the axial direction toward the motor, thereby restricting relative rotation between the pinion tube and the output shaft.

The pinion tube may have formed therein a cylindrical bore which has a first part and a second part that has a larger diameter than the first part and is positioned closer to the motor than the first part is. The female helical splines of the pinion tube may be formed on the inner surface of the second part of the cylindrical bore. The radial clearance between the inner surface of the first part of the cylindrical bore and the outer surface of the output shaft may be preferably set so small that they make up sliding surfaces against each other.

The starter may have such a cantilever structure that on the non-motor side of the pinion, there is provided no bearing for supporting the pinion tube.

BRIEF DESCRIPTION OF THE DRAWINGS

The present invention will be understood more fully from the detailed description given hereinafter and from the accompanying drawings of one exemplary embodiment, which, however, should not be taken to limit the invention to the specific embodiment but are for the purpose of explanation and understanding only.

In the accompanying drawings.

DESCRIPTION OF EMBODIMENT

Figure 1:
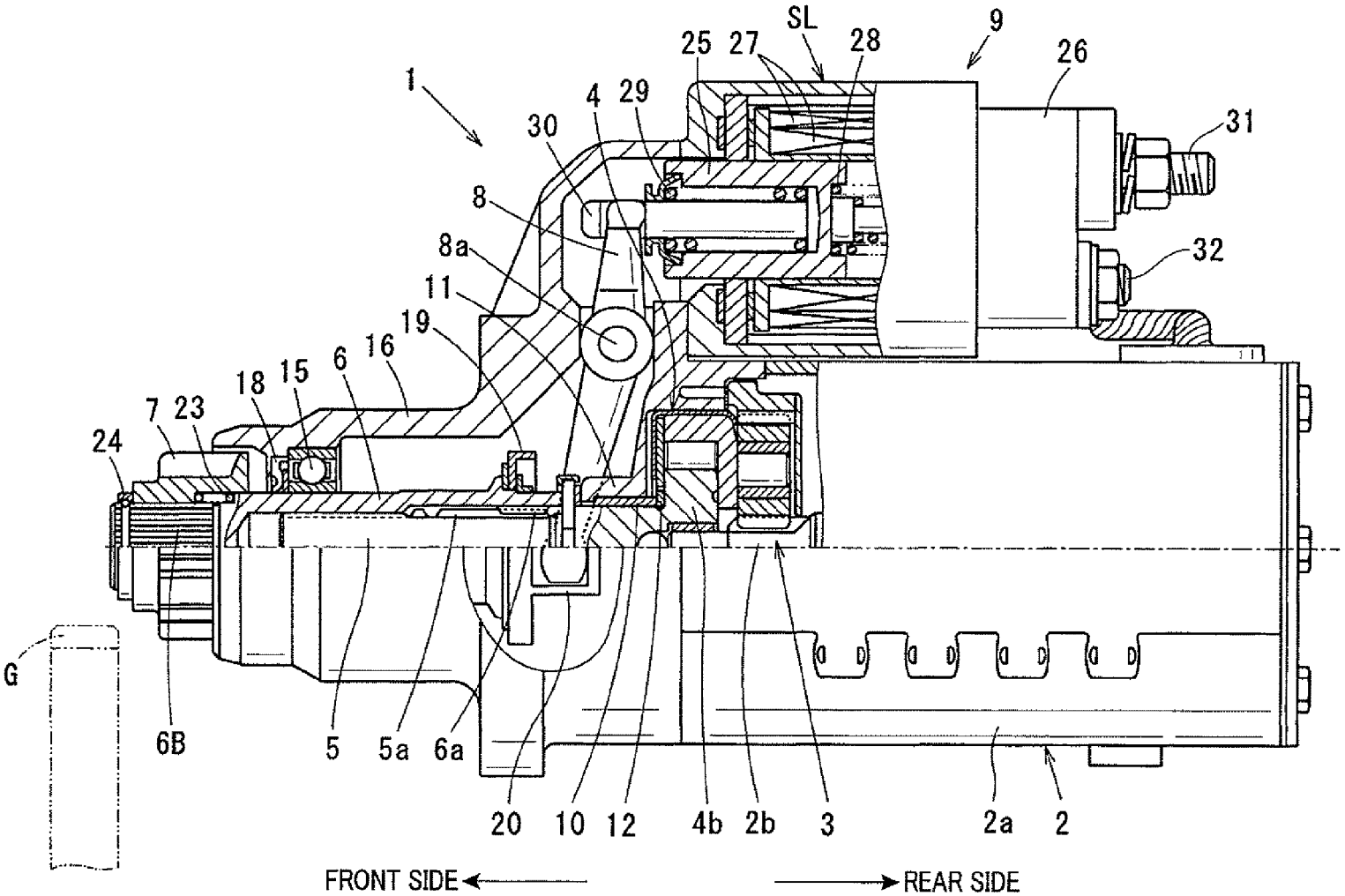
FIG. 1 is a partially cross-sectional view illustrating the overall structure of a starter according to an exemplary embodiment.

FIG. 1 shows the overall structure of a starter 1 according to an exemplary embodiment. The starter 1 is designed to start an internal combustion engine (not shown) of a motor vehicle.

As shown in FIG. 1, the starter 1 includes: a motor 2 that generates torque; a speed reducer 3 that reduces the rotational speed of the motor 2; a clutch 4; an output shaft 5 that is mechanically connected to the output side of the speed reducer 3 via the clutch 4; a pinion tube 6 that is helical-spline-fitted to the outer periphery of the output shaft 5; a pinion 7 that is fitted on a non-motor-side end portion (i.e., a left end portion in FIG. 1) of the pinion tube 6 so as to rotate with the pinion tube 6; a shift lever 8 that is configured to shift both the pinion tube 6 and the pinion 7 relative to the output shaft 5 in the axial direction away from the motor 2 (i.e., in the leftward direction in FIG. 1) and thereby bring the pinion 7 into mesh with a ring gear G of the engine; and an electromagnetic switch 9 that is configured to operate supply of electric power to the motor 2 and drive the shift lever 8.

It should be noted that for the sake of convenience of explanation, the non-motor side in the axial direction of the output shaft 5 (or the axial direction of the starter 1) will be simply referred to as the front side and the motor side (i.e., the right side in FIG. 1) in the axial direction will be simply referred to as the rear side hereinafter.

The motor 2 is implemented by, for example, a DC commutator motor. Specifically, the motor 2 includes: a hollow cylindrical yoke 2*a* that also serves as a frame; a field (not shown) formed by arranging either a plurality of permanent magnets or a field winding on the radially inner periphery of the yoke 2*a*; an armature that has an armature shaft 2*h* rotatably disposed radially inside of the field and a commutator (not shown) provided on the outer periphery of the armature shaft 2*b*; and brushes (not shown) arranged to slide on the commutator during rotation of the armature shaft 2*b* so as to supply electric power to the armature.

In operation, when main contacts (not shown) of a motor circuit are closed by the electromagnetic switch 9, electric power is supplied from a battery (not shown) to the armature via the sliding contact between the brushes and the commutator. Consequently, torque is generated at the armature shaft 2*b* by interaction between the field and the energized armature.

Figure 2A:
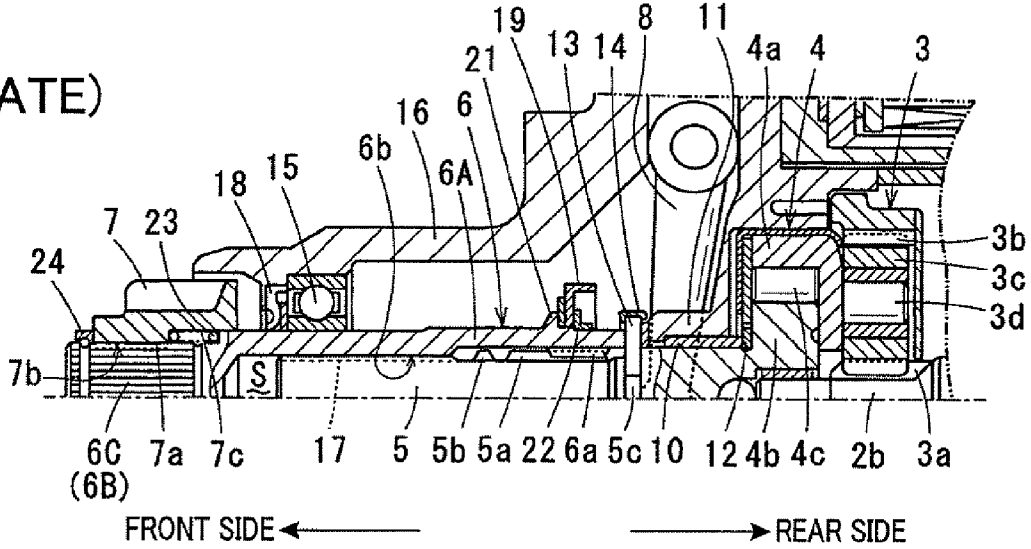
FIG. 2A is a partially cross-sectional view illustrating the positions of a pinion tube and a pinion of the starter when the starter is in a stopped state.

The speed reducer 3 is of, for example, a well-known epicyclic type (or planetary type). Specifically, as shown in FIG. 2A, the speed reducer 3 includes: a sun gear 3*a* provided on a front end portion (i.e., a left end portion in FIG. 2A) of the armature shaft 2*b* of the motor 2; an annular internal gear 3*b* concentrically arranged with the sun gear 3*a*; and a plurality (e.g., three) of planet gears 3*c* arranged so as to mesh with both the sun gear 3*a* and the internal gear 3*b*.

In operation, when the sun gear 3*a* rotates along with the armature shaft 2*b* of the motor 2, the planet gears 3*c* rotate about respective gear shafts 3*d* as well as orbit around the sun gear 3*a*, thereby reducing the rotational speed of the armature shaft 2*b* and the sun gear 3*a* to an orbital speed of the planet gears 3*c*.

Figure 2B:
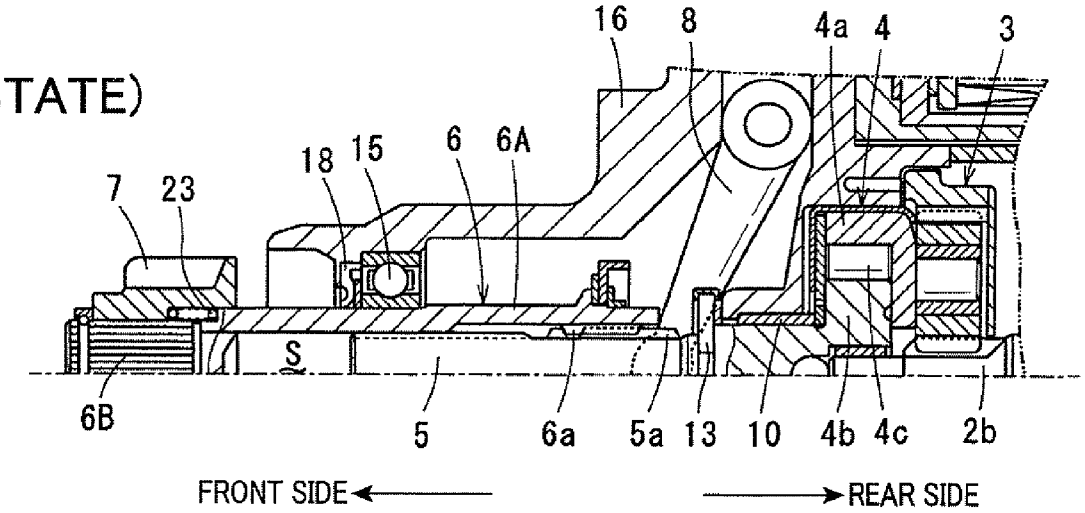
FIG. 2B is a partially cross-sectional view illustrating the positions of the pinion tube and the pinion when the starter is in a driving state.
Figure 3:
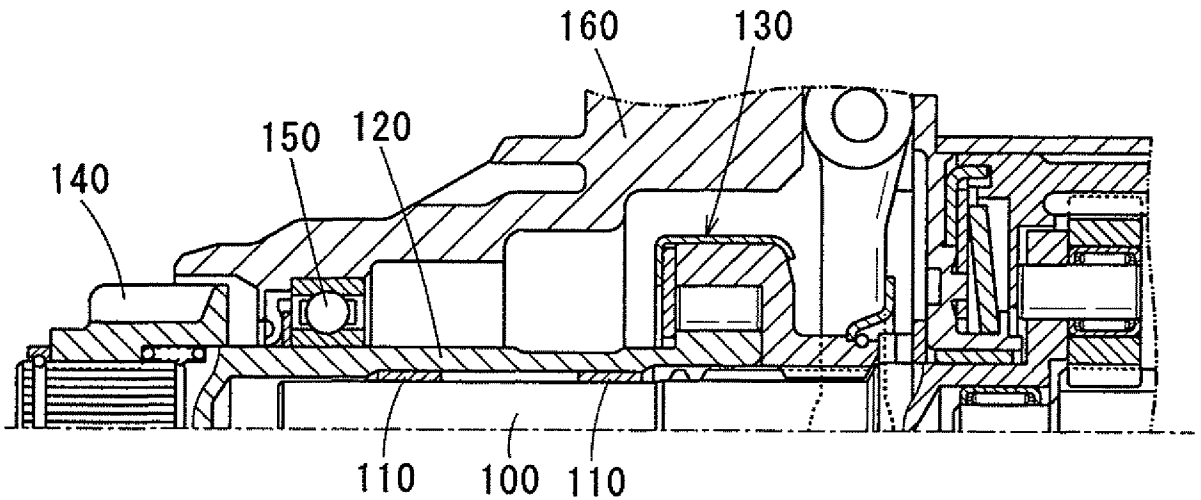
FIG.3 (PRIOR ART)
FIG. 3 is a partially cross-sectional view of part of a starter known in the prior art.

The clutch 4 is implemented by a one-way roller clutch which is configured to allow torque transmission from the motor 2 to the engine and inhibit torque transmission from the engine to the motor 2. Specifically, as shown in FIGS. 2A-2B, the clutch 4 includes an outer 4*a*, an inner 4*b*, a plurality of rollers 4*c* and a plurality of springs (not shown). The outer 4*a* is integrally formed with the gear shafts 3*d* that respectively support the planet gears 3*c* of the speed reducer 3. The outer 4*a* also has a plurality of wedge-shaped cam chambers (not shown) formed in the inner periphery thereof. The inner 4*b* is disposed radially inside of the outer 4*a* so as to be rotatable relative to the outer 4*a*. Each of the rollers 4*c* is received in a corresponding one of the cam chambers of the outer 4*a* so as to be radially interposed between the outer 4*a* and the inner 4*b*. Each of the springs is arranged in a corresponding one of the cam chambers of the outer 4*a* so as to urge that one of the rollers 4*c* which is received in the corresponding cam chamber toward the narrower side of the corresponding cam chamber.

During the starting of the engine by the starter 1, the clutch 4 allows torque transmission from the outer 4*a* to the inner 4*b* by locking them together with the rollers 4*c*. On the other hand, when the engine has been completely started and thus the pinion 7 comes to be rotated by the engine, the clutch 4 enters an overrun state where it inhibits torque transmission from the inner 4*b* to the outer 4*a* with the rollers 4*c* freewheeling between the outer 4*a* and the inner 4*b*.

The output shaft 5 is coaxially disposed with the armature shaft 2*b* of the motor 2. The output shaft 5 has a rear end portion that is integrally formed with the inner 4*b* of the clutch 4 and rotatably supported by a center case 11 via a bearing 10. On the rear side of the bearing 10, there is disposed a washer 12 to suppress wear of the bearing 10 and the inner 4*b* of the clutch 4 due to relative rotation therebetween.

In addition, as shown in FIGS. 2A-2B, in the present embodiment, the bearing 10 is implemented by a sliding bearing (or plain bearing). However, it should be noted that the bearing 10 may also be implemented by other types of bearings, such as a ball bearing and a needle bearing.

Further, the output shaft 5 has male helical splines 5*a* that are formed on the outer surface of the output shaft 5 so as to be positioned forward from the rear end portion of the output shaft 5 which is supported by the bearing 10. The output shaft 5 also has a front stopper 5*b* that is formed on the outer surface of the output shaft 5 so as to be positioned forward from the male helical splines 5*a*. As will be described in detail later, the front stopper 5*b* is provided to stop the pinion tube 6 from advancing further forward, thereby defining a maximum advanced position of the pinion tube 6.

Furthermore, the output shaft 5 also has an annular groove 5*c* that is formed in the outer surface of the output shaft 5 so as to extend over the entire circumference of the output shaft 5. The annular groove 5*c* is axially positioned between the male helical splines 5*a* and the rear end portion of the output shaft 5 which is supported by the bearing 10.

In the annular groove 5*c* of the output shaft 5, there is mounted a rear stopper (or stopping member) 13 to stop the pinion tube 6 from retreating further backward, thereby defining a maximum retreated position of the pinion tube 6. In addition, the maximum retreated position also represents an initial rest position of the pinion tube 6.

More specifically, the rear stopper 13 is implemented by, for example, at least one E-clip that is fitted into the annular groove 5*c* of the output shaft 5. Further, a cover 14 is provided to cover the radially outer periphery of the E-clip, thereby preventing the E-clip from being radially moved out of the annular groove 5*c* by the centrifugal force during rotation of the output shaft 5.

The pinion tube 6 has, as shown in FIG. 2A, a main body 6A and a pinion-sliding portion 6B. The main body 6A has a cylindrical bore 6*b* formed therein. The cylindrical bore 6*b* extends in the axial direction of the pinion tube 6 and has an open end on the rear side and a closed end (or a bottom) on the front side. Further, on the inner surface of a rear part of the cylindrical bore 6*b*, there are formed female helical splines 6*a*. The pinion-sliding portion 6B is positioned on the front side of the main body 6A and has a smaller outer diameter than the main body 6A. Further, on the outer surface of the pinion-sliding portion 6B, there are formed straight spline teeth 6*c* that extend in the axial direction of the pinion tube 6.

The pinion tube 6 is rotatably and axially-slidably supported, at the outer surface of the main body 6A thereof, by a housing 16 via a bearing 15. Further, the pinion tube 6 has the output shaft 5 inserted in the cylindrical bore 6*b* of the main body GA so that the pinion tube 6 is both rotatable and axially movable relative to the output shaft 5 via the meshing engagement between the male helical splines 5*a* of the output shaft 5 and the female helical splines 6*a* of the pinion tube 6. Furthermore, the pinion tube 6 assumes (or gets to) its maximum advanced position when the front ends of the female helical splines 6*a* are advanced to make contact with the read end of the front stopper 5*b* of the output shaft 5.

In addition, as shown in FIGS. 2A-2B, in the present embodiment, the bearing 15 is implemented by a ball bearing. However, it should be noted that the bearing 15 may also be implemented by other types of bearings, such as a needle bearing or a sliding bearing.

For the cylindrical bore 6*b* of the main body 6A of the pinion tube 6, the diameter of the rear part of the cylindrical bore 6*b* is set to be larger than that of a front part of the cylindrical bore 6*b*. As described previously, the female helical splines 6*a* are formed on the inner surface of the rear part of the cylindrical bore 6*b*. Further, the diameter of the rear part of the cylindrical bore 6*b* is substantially equal to the root diameter of the female helical splines 6*a*.

On the other hand, no splines are formed on the inner surface of the front part of the cylindrical bore 6*b*. Further, the radial clearance between the inner surface of the front part of the cylindrical bore 6*b* and the outer surface of a front part of the output shaft 5 is set to be smaller than the radial clearance between the male helical splines 5*a* of the output shaft 5 and the female helical splines 6*a* of the pinion tube 6. Consequently, the inner surface of the front part of the cylindrical bore 6*b* and the outer surface of the front part of the output shaft 5 make up sliding surfaces against each other. In addition, the front part of the output shaft 5 is positioned forward of the front stopper 5*b* so as to have the front stopper 5*b* axially interposed between the front part of the output shaft 5 and the male helical splines 5*a*.

Furthermore, in the outer surface of the front part of the output shaft 5, there are formed a plurality (e.g., two) of grooves 17 that extend in the axial direction of the output shaft 5. Via the grooves 17, an internal space S formed between the front end of the output shaft 5 and the closed end of the cylindrical bore 6*b* of the pinion tube 6 communicates with the rear part of the cylindrical bore 6*b* during the entire time period from when the starter 1 is in a stopped state as shown in FIG. 2A to when the starter 1 is brought into a driving state as shown FIG. 2B. Here, the driving state of the starter 1 denotes a state where the pinion 7 has been brought into mesh with the ring gear G (see FIG. 1) of the engine and the torque generated by the motor 2 is transmitted from the pinion 7 to the ring gear G to start the engine.

In addition, it should be noted that the grooves 17 may also be formed in the inner surface of the front part of the cylindrical bore 6*b* instead of in the outer surface of the front part of the output shaft 5.

The starter 1 further includes a seal member 18 that is provided on the outer periphery of the main body 6A of the pinion tube 6 so as to be positioned in front of the bearing 15. The seal member 18 functions to block foreign matter, such as water and dust, from intruding into the starter 1. In the present embodiment, the seal member 18 is implemented by, for example, a rubber-made oil seal. The seal member 18 is retained by the housing 16 with a lip portion of the seal member 18 in sliding contact with the outer surface of the main body 6A of the pinion tube 6.

On the rear side of the pinion tube 6, there is provided means for transmitting a shifting force (or pushing force) of the shift lever 8 to the pinion tube 6; the shifting force is created by operation of the electromagnetic switch 9 in the axial direction away from the motor 2 (i.e., in the forward direction).

Specifically, in the present embodiment, the shifting force-transmitting means is made up of a resin-made annular collar 19, a lever-engaging member 20 and first and second restricting members 21 and 22. As shown in. FIGS. 1 and 2A-2B, the collar 19 is fitted to the outer periphery of the main body 6A of the pinion tube 6 so as to be rotatable relative to the pinion tube 6. The lever-engaging member 20 is integrally resin-formed with the collar 19 and arranged so as to engage with one end of the shift lever 8. The first restricting member 21 restricts movement of the collar 19 in the axial direction toward the pinion 7 (i.e., in the forward direction). The first restricting member 21 is integrally formed with the pinion tube 6 and shaped into an annular flange that protrudes radially outward from the outer surface of the pinion tube 6 and circumferentially extends over the entire circumference of the pinion tube 6. On the other hand, the second restricting member 22 restricts movement of the collar 19 in the axial direction away from the pinion 7 (i.e., in the backward direction). The second restricting member 22 is separately formed from the pinion tube 6 so as to have an annular shape and fixed to the outer surface of the pinion tube 6. More specifically, the second restricting member 22 is implemented by, for example, a washer that is press-fitted to the outer periphery of the main body 6A of the pinion tube 6. In addition, it should be noted that the first restricting member 21 may also be formed in the same manner as the second restricting member 22.

The pinion 7 is separately formed from the pinion tube 6 and fitted on the pinion-sliding portion 6B of the pinion tube 6 so as to be axially movable relative to the pinion-sliding portion 6B. Further, the pinion 7 is urged by a pinion spring 23 in the axial direction away from the motor 2 (i.e., in the forward direction). The pinion 7 is also restricted in movement in the axial direction away from the motor 2 by a pinion stopper 24 that is provided at the front end of the pinion-sliding portion 6B of the pinion tube 6.

Moreover, the pinion 7 has both a small-diameter bore 7*b* and a large-diameter bore 7*c* formed therein; the diameter of the large-diameter bore 7*c* is larger than that of the small-diameter bore 7*b*.

More specifically, the small-diameter bore 7*b* is formed on the front side so as to extend in the axial direction of the pinion 7 and open at the front end of the pinion 7. Further, in the inner surface of the small-diameter bore 7*b*, there are formed straight spline grooves 7*a* that extend in the axial direction of the pinion 7. On the other hand, the large-diameter bore 7*c* is formed on the rear side so as to extend in the axial direction of the pinion 7 and open at the rear end of the pinion 7. However, in the inner surface of the large-diameter bore 7*c*, there are formed no spline grooves. In addition, the small-diameter bore 7*b* and the large-diameter bore 7*c* communicate with each other in the axial direction of the pinion 7.

The pinion 7 is relatively-movably assembled to the pinion tube 6 by inserting the pinion-sliding portion 6B of the pinion tube 6 through the large-diameter bore 7*c* into the small-diameter bore 7*b* of the pinion 7 and thereby bringing the straight spline teeth 6*c* of the pinion tube 6 into mesh with the straight spline grooves 7*a* of the pinion 7. In addition, a front end portion of the main body 6A of the pinion tube 6 is fitted into a rear end portion of the large-diameter bore 7*c* of the pinion 7.

The pinion spring 23 is axially interposed between a radially-extending outer shoulder that is formed between the outer surfaces of the main tube 6A and pinion-sliding portion 6B of the pinion tube 6 and a radially-extending inner shoulder that is formed between the inner surfaces of the small-diameter bore 7*b* and large-diameter bore 7*c* of the pinion 7.

Referring again to FIG. I, the electromagnetic switch 9 includes: an electromagnetic solenoid SL that drives a plunger 25 by the attraction of an electromagnet and has a frame that also forms a magnetic circuit of the electromagnetic solenoid SL; and a resin cover 26 that receives the main contacts of the motor circuit therein and is crimp-fixed to an open end of the frame of the electromagnetic solenoid SL.

More specifically, the electromagnetic solenoid SL includes: an excitation coil 27 that forms the electromagnet upon being supplied with electric power; the plunger 25 that is axially-movably disposed radially inside of the excitation coil 27; a return spring 28 that returns the plunger 25 to its initial rest position when the electric power supply to the excitation coil 27 is interrupted and thus the attraction of the electromagnet for the plunger 25 disappears; a drive spring 29 for developing a reaction force for shifting the pinion 7 into mesh with the ring gear G of the engine; and a joint 30 for transmitting motion of the plunger 25 to the shift lever 8 via the drive spring 29.

The main contacts of the motor circuit are made up of a pair of fixed contacts (not shown) and a movable contact (not shown). The fixed contacts are connected to the motor circuit via a pair of terminal bolts 31 and 32, respectively; both the terminal bolts 31 and 32 are fixed to the resin cover 26. The movable contact is configured to move along with the plunger 25 to electrically connect and disconnect the fixed contacts.

More specifically, when the plunger 25 is attracted by the attraction of the electromagnet to move backward (i.e., rightward in FIG. 1), the movable contact also moves backward to make contact with and thereby electrically connect the fixed contacts. Consequently, the main contacts of the motor circuit are closed. On the other hand, when the attraction of the electromagnet disappears and thus the plunger 25 is returned by the return spring 28 forward (i.e., leftward in FIG. 1) to its initial rest position, the movable contact also moves forward to get away from and thereby electrically disconnect the fixed contacts. Consequently, the main contacts of the motor circuit are opened.

The shift lever 8 has a fulcrum portion 8*a* rotatably supported by the housing 16, so that it can pivot on the fulcrum portion 8*a*. Further, one end of the shift lever 8 which is on one side of the fulcrum portion 8*a* is arranged to engage with the lever-engaging member 20 as described previously. The other end of the shift lever 8 which is on the other side of the fulcrum portion 8*a* is mechanically connected to the joint 30 of the electromagnetic switch 9.

Next, operation of the starter 1 according to the present embodiment will be described.

When a starter switch (not shown) of the vehicle is turned on, the excitation coil 27 of the electromagnetic switch 9 is supplied with electric power from the battery, thereby forming the electromagnet. The electromagnet attracts the plunger 25 to move backward against the reaction force of the return spring 28. The backward movement of the plunger 25 causes the shift lever 8 to pivot clockwise, thereby shifting both the pinion tube 6 and the pinion 7 forward along the output shaft 5. Further, when a front end face of the pinion 7 comes to make contact with a rear end face of the ring gear G of the engine, the pinion 7 is stopped and thus only the pinion tube 6 is further shifted forward against the reaction force of the pinion spring 23.

Then, the plunger 25 further moves backward against both the reaction forces of the return spring 28 and the drive spring 29, thereby causing the main contacts of the motor circuit to be closed. Consequently, electric power is supplied from the battery to the motor 2, thereby enabling the motor 2 to generate torque. The generated torque is then amplified by the speed reducer 3 and transmitted to the pinion tube 6 via the clutch 4 and the output shaft 5, thereby causing the pinion tube 6 to rotate together with the pinion 7. When the pinion 7 has rotated to a position where it can be meshed with the ring gear G, the pinion tube 6 and the pinion 7 are together shifted forward by both the reaction force developed in the drive spring 29 and an axial thrust and the pinion 7 is alone further shifted forward by the reaction force of the pinion spring 23. Here, the axial thrust is converted from the torque generated by the motor 2 via the meshing engagement between the male helical splines 5*a* of the output shaft 5 and the female helical splines 6*a* of the pinion tube 6. Consequently, the pinion 7 is brought into mesh with the ring gear G, thereby allowing the torque generated by the motor 2 to be transmitted from the pinion 7 to the ring gear G to start the engine.

After the engine has been completely started, the starter switch is turned off, thereby interrupting the electric power supply from the battery to the excitation coil 27 of the electromagnetic switch 9. Consequently, the attraction of the electromagnet for the plunger 25 disappears, so that the plunger 25 is moved forward by the reaction force of the return spring 28 to its initial rest position, causing the main contacts of the motor circuit to be opened. As a result, the electric power supply from the battery to the motor 2 is also interrupted, thereby disabling the motor 2 from rotating and generating torque. At the same time, the forward movement of the plunger 25 causes the shift lever 8 to pivot counterclockwise, thereby shifting both the pinion tube 6 and the pinion 7 backward along the output shaft 5 to their respective initial rest positions as shown in FIG. 2A. As a result, the pinion 7 is brought out of mesh with the ring gear G The above-described starter 1 according to the present embodiment has the following advantages.

In the starter 1, the pinion-sliding portion 6B of the pinion tube 6 is provided at the front end of the pinion tube 6 and positioned forward from the bearing 15 via which the pinion tube 6 is supported by the housing 16. In other words, the pinion-sliding portion 6B is provided at the non-motor-side end of the pinion tube 6 and positioned further from the motor 2 than the bearing 15 is. Moreover, on the pinion-sliding portion 6B of the pinion tube 6, there is straight-spline-fitted the pinion 7 so as to rotate with the pinion tube 6. That is to say, the starter 1 has such a cantilever structure that on the front side (i.e., on the non-motor side) of the pinion 7, there is provided no bearing for supporting the pinion tube 6. In operation, when the engine has been completely started and thus the pinion 7 comes to be rotated by the engine, the clutch 4 enters the overrun state where it inhibits torque transmission from the inner 4*b* (i.e., from the output shaft 5 side) to the outer 4*a* (i.e., to the motor 2 side). At this time, however, relative rotation between the output shaft 5 and the pinion tube 6 is restricted by a relative rotation restricting means of the starter 1, unlike in the conventional starter as disclosed in Japanese Patent Application Publication No. 2006-177168.

More specifically, in the present embodiment, the relative rotation restricting means is made up of the male helical splines 5*a* of the output shaft 5, the female helical splines 6*a* of the pinion tube 6 and the shift lever 8. When the clutch 4 is in the overrun state, an axial thrust will act on the pinion tube 6 in the backward direction (i.e., in the axial direction toward the motor 2); the axial thrust is converted from the torque generated by the engine via the meshing engagement between the male helical splines 5*a* and the female helical splines 6*a*. However, at this time, the shift lever 8 will bear the axial thrust and thereby stop the backward movement of the pinion tube 6 and the tooth surfaces of the male helical splines 5*a* will abut against those of the female helical splines 6*a* in the rotating direction of the pinion tube 6, thereby restricting relative rotation between the output shaft 5 and the pinion tube 6.

Consequently, without relative rotation between the output shaft 5 and the pinion tube 6, it is possible to reliably suppress wear of the outer surface of the output shaft 5 and the inner surface of the pinion tube 6 even when the vehicle is equipped with an ISS and thus the number of times the starter 1 starts the engine of the vehicle is dramatically increased. Therefore, it is unnecessary to provide a large radial clearance between the outer surface of the output shaft 5 and the inner surface of the pinion tube 6 for the purpose of suppressing wear of the two surfaces. In other words, it is possible to minimize the radial clearance between the outer surface of the output shaft 5 and the inner surface of the pinion tube 6. As a result, with the minimized radial clearance, it is also possible to minimize relative inclination between the output shaft 5 and the pinion tube 6.

Further, with the minimized relative inclination between the output shaft 5 and the pinion tube 6, it is possible to reliably prevent local increase in contact pressure between the male helical splines 5*a* of the output shaft 5 and the female helical splines 6*a* of the pinion tube 6, thereby reliably preventing adhesion between the tooth surfaces of the male and female helical splines 5*a* and 6*a*. As a result, it is possible to secure high durability (or a long service life) of the starter 1.

Furthermore, without relative rotation between the output shaft 5 and the pinion tube 6, it is unnecessary to provide a bearing between the outer surface of the output shaft 5 and the inner surface of the pinion tube 6. Consequently, without having to provide a bearing between the outer surface of the output shaft 5 and the inner surface of the pinion tube 6, it is possible to minimize the parts count and thus the manufacturing cost of the starter 1. Moreover, without a bearing provided between the outer surface of the output shaft 5 and the inner surface of the pinion tube 6, it is possible to more effectively minimize the radial clearance therebetween.

In addition, even if a bearing was provided between the outer surface of the output shaft 5 and the inner surface of the pinion tube 6, it would be possible to reliably prevent seizure of the bearing because relative rotation between the output shaft 5 and the pinion tube 6 would be restricted by the relative rotation restricting means when the clutch 4 is in the overrun state.

Moreover, in the starter 1 according to the present embodiment, the cylindrical bore 6*b* of the pinion tube 6 has different diameters at the front and rear parts. More specifically, the diameter of the rear part of the cylindrical bore 6*b* is set to be larger than that of the front part of the cylindrical bore 6*b*. The female helical splines 6*a* are formed on the inner surface of the rear part of the cylindrical bore 6*b*, whereas no splines are formed on the inner surface of the front part of the cylindrical bore 6*b*. Further, the radial clearance between the inner surface of the front part of the cylindrical bore 6*b* and the outer surface of the output shaft 5 is set so small that the inner surface of the front part of the cylindrical bore 6*b* and the outer surface of the output shaft 5 make up sliding surfaces against each other.

With the radial clearance between the inner surface of the front part of the cylindrical bore 6*b* and the outer surface of the output shaft 5 set so small as described above, it is still possible to reliably prevent wear of the inner surface of the front part of the cylindrical bore 6*b* and the outer surface of the output shaft 5 because relative rotation between the output shaft 5 and the pinion tube 6 is restricted by the relative rotation restricting means when the clutch 4 is in the overrun state. Moreover, by setting the radial clearance between the inner surface of the front part of the cylindrical bore 6*b* and the outer surface of the output shaft 5 so small as described above, it is possible to further reduce relative inclination between the output shaft 5 and the pinion tube 6, thereby more efficiently transmitting the torque generated by the motor 2 to the engine.

While the above particular embodiment has been shown and described, it will be understood by those skilled in the art that various modifications, changes, and improvements may be made without departing from the spirit of the invention.

For example, in the previous embodiment, the clutch 4 is implemented by the one-way roller clutch in which the rollers 4*c* are interposed as intermediate members between the outer 4*a* and the inner 4*b*. However, the clutch 4 may also be implemented by other types of one-way clutches, such as a one-way sprag clutch which includes sprags instead of the rollers 4*c* and a one-way cam clutch which includes cams instead of the rollers 4*c*.

In the previous embodiment, the motor 2 is implemented by the DC commutator motor. However, the motor 2 may also be implemented by other types of motors, such as an AC motor.

In the previous embodiment, the pinion 7 is separately formed from the pinion tube 6 and straight-spline-fitted on the pinion tube 6. However, the pinion 7 may also be integrally formed with the pinion tube 6 into one piece. In the previous embodiment, the electromagnetic switch 9 includes the single electromagnetic solenoid SL which performs both the function of driving the shift lever 8 and the function of operating (i.e. closing and opening) the main contacts of the motor circuit.

However, the electromagnetic switch 9 may also be implemented by a tandem electromagnetic switch which includes first and second electromagnetic solenoids arranged in tandem; the first electromagnetic solenoid performs the function of driving the shift lever 8, while the second electromagnetic solenoid performs the function of operating the main contacts of the motor circuit. Further, the first and second electromagnetic solenoids may be both received in a common frame or respectively received in two different frames.

In addition, in the case of the electromagnetic switch 9 being implemented by a tandem electromagnetic switch, it is possible to separately control the operations of the first and second electromagnetic solenoids by an ECU (Electronic Control Unit), thereby making the starter 1 more suitable for use in a vehicle that is equipped with an ISS.

What is claimed is:

1. A starter for starting an engine, the starter comprising:

a motor having a rotating shaft;

an output shaft coaxially disposed with the rotating shaft of the motor, the output shaft having male helical splines formed on an outer surface thereof;

a one-way clutch configured to allow torque transmission from the motor to the output shaft and inhibit torque transmission from the output shaft to the motor, the one-way clutch being provided at a motor-side end of the output shaft;

a pinion tube having female helical splines formed on an inner surface thereof, the pinion tube being fitted on the output shaft with the female helical splines in mesh with the male helical splines of the output shaft;

a pinion provided on a non-motor-side end portion of the pinion tube so as to rotate with the pinion tube;

a shift lever that is configured to shift both the pinion tube and the pinion relative to the output shaft in a direction away from the motor and thereby bring the pinion into mesh with a ring gear of the engine; and means for restricting relative rotation between the pinion tube and the output shaft when the one-way clutch is in an overrun state where the clutch inhibits torque transmission from the output shaft to the motor;

means for transmitting a shifting force of the shift lever to the pinion tube, the shifting force transmitting means being provided at the pinion tube and being provided on an outer periphery of the pinion tube so as to be interposed between the one-way clutch and the pinion in an axial direction of the output shaft; and wherein the means for transmitting a shifting force includes an annular collar fitted on an outer periphery of the motor-side end portion of the pinion tube so as to be rotatable relative to the pinion tube;

an electromagnetic switch configured to create the shifting force of the shift lever, the electromagnetic switch being arranged outside the motor and non-coaxial with the pinion tube, wherein:

the shift lever includes a fulcrum portion, on which the shift lever is pivotable, and further includes first and second ends respectively on opposite sides of the fulcrum portion, the first end of the shift lever is mechanically connected to the shifting force transmitting means, the second end of the shift lever is mechanically connected to the electromagnetic switch, and the shift lever shifts, via the shifting force-transmitting means, both the pinion tube and the pinion, but does not shift the one-way clutch.

2. The starter as set forth in claim 1, wherein the electromagnetic switch includes an electromagnetic solenoid that has an excitation coil that forms an electromagnet upon being supplied with electric power, and the shifting force of the shift lever is created by attraction of the electromagnet.

3. The starter as set forth in claim 1, wherein the relative rotation restricting means is made up of the male helical splines of the output shaft, the female helical splines of the pinion tube and the shift lever, and when the one-way clutch is in the overrun state, tooth surfaces of the male helical splines abut against tooth surfaces of the female helical splines in a rotating direction of the pinion tube and the shift lever bears an axial thrust, which is created by meshing engagement between the male and female helical splines to act on the pinion tube in a direction toward the motor, thereby restricting relative rotation between the pinion tube and the output shaft.

4. The starter as set forth in claim 1, wherein the pinion tube has a cylindrical bore formed therein, the cylindrical bore has a first part and a second part that has a larger diameter than the first part and is positioned closer to the motor than the first part is, the female helical splines of the pinion tube are formed on the inner surface of the second part of the cylindrical bore, and a radial clearance between the inner surface of the first part of the cylindrical bore and the outer surface of the output shaft is set at an amount whereby the inner surface of the first part of the cylindrical bore and the outer surface of the output shaft make up sliding surfaces against each other.

5. The starter as set forth in claim 1, wherein the starter has such a cantilever structure that on the non-motor side of the pinion, there is provided no bearing for supporting the pinion tube.

6. The starter as set forth in claim 1, wherein the shifting force transmitting means is provided on a motor-side end portion of the pinion tube.

7. The starter as set forth in claim 6, wherein the shifting force transmitting means includes:

a lever-engaging member integrally formed with the collar and arranged so as to engage with the first end of the shift lever;

a first restricting member provided on the non-motor side of the collar to restrict movement of the collar in the direction away from the motor; and a second restricting member provided on the motor-side of the collar to restrict movement of the collar in the direction toward the motor.

* * * * *